United States Patent [19]

Krob et al.

[11] 4,421,341

[45] Dec. 20, 1983

[54] SAFETY SKI BINDING

[75] Inventors: Erwin Krob; Helmut Bauer, both of Vienna, Austria

[73] Assignee: TMC Corporation, Baar, Switzerland

[21] Appl. No.: 265,750

[22] Filed: May 21, 1981

[30] Foreign Application Priority Data

May 23, 1980 [AT] Austria ..... 2769/80

[51] Int. Cl.[3] ..... A63C 9/08

[52] U.S. Cl. ..... 280/628

[58] Field of Search ..... 280/628, 630–632

[56] References Cited

U.S. PATENT DOCUMENTS

| | | | |
|---|---|---|---|
| 3,876,219 | 4/1975 | Smolka et al. | 280/628 |
| 3,933,363 | 11/1976 | Schweizer et al. | 280/626 |

FOREIGN PATENT DOCUMENTS

| | | | |
|---|---|---|---|
| 2628748 | 12/1977 | Fed. Rep. of Germany | 280/631 |
| 2838904 | 3/1980 | Fed. Rep. of Germany | 280/632 |
| 488467 | 7/1970 | Switzerland | 280/628 |

*Primary Examiner*—Joseph F. Peters, Jr.
*Assistant Examiner*—Timothy Roesch
*Attorney, Agent, or Firm*—Flynn, Thiel, Boutell & Tanis

[57] ABSTRACT

A safety ski binding has a support member supported for pivotal movement about a vertical axis, and a sole holder is supported on the support member for pivotal movement about a horizontal axis. A lever supported on the support member for pivotal movement about a horizontal axis has a first locking element engageable with a second locking element on the rear of the sole holder and has a control surface on its side opposite the first locking element. A housing for a release spring is supported on the support member for pivotal movement about a horizontal axis and has a sliding element which the release spring urges against the control surface on the lever. A centering spring cooperable with the support member and housing pivotally urges the housing to a position in which the sliding member is engaging the control surface of the lever. A second set of locking elements yieldably resists pivotal movement of the support member.

27 Claims, 16 Drawing Figures

SAFETY SKI BINDING

FIELD OF THE INVENTION

This invention relates to a safety ski binding having a sole holder which is pivotal about a horizontal and a vertical axis, which sole holder is held in its normal position holding the ski shoe by cooperating locking elements which yield only when elevational and lateral release forces exceed predetermined limits, the effective release force being reduced with an increasing change of the force direction from the vertical, preferably until a predetermined limit, and the locking elements being provided on a carrier.

BACKGROUND OF THE INVENTION

A safety ski binding of the above-mentioned type is described in Austrian Pat. No. 338 151. In this conventional construction, a pivotally supported lever is arranged between two locking elements, the release spring pressing the locking element for the elevational release against the lever and the lever pressing in turn against the locking element for the lateral release. The locking part for the elevational release locking element which is arranged movably or swingably on the housing is constructed on the lever, which carries at the same time a locking part which is responsible for the lateral release. Due to this construction, the sole down-holding means is pivotal in the horizontal plane about two aligned kingpins which are secured on a part of the sole holder which is pivotal about a horizontal axis, wherein the entire sole holder is pivotal about the aforementioned horizontal axis in a vertical plane. The construction of the locking elements for the horizontal release is disadvantageous because for this, in various forms of construction, a ball lock is used. A further disadvantage consists in the one part of the sole holder being designed pivotally about the other part of the same structural part, which causes either high frictional forces to occur or stability deficiencies in the sole holder.

A similar safety ski binding has become known from German OS No. 18 06 780 (corresponds to U.S. Pat. No. 3,620,545). In this safety ski binding, both locking devices for the elevational and lateral release forces are formed by one common locking member and by one notch carrier which cooperates with the locking member and is effective for both the elevational and also the lateral release. The locking carrier has thereby control surfaces which are important for the elevational and the lateral release. A disadvantage of this conventional construction lies in both the locking element and also the notch carrier being responsible for two release directions. From this it follows that, in particular due to structural limitations, compromises must be accepted. Practical experience has shown that such compromises were not fully satisfactory and, in the case of a product which was indeed sold on the market, a further control cam has been included to control the lateral release, which control cam is provided between the base plate and the housing of the ski binding. This embodiment has in turn the disadvantage that snow, ice or the like can accumulate between the base plate and housing, causing the release operations to possibly become uncontrollable. The practical constructions show that the solution described in the above-mentioned German OS alone is not fully satisfactory for practical use. Furthermore, voluntary stepping out occurs against the force of a release spring.

Austrian Pat. No. 305 843 (which corresponds to U.S. Pat. No. 3,876,219) has suggested effecting the second locking between the sole holder and an approximately cam-plate-shaped locking member. Even though this construction has proven successful in practice, it is disadvantageous that stepping into the released binding under difficult ground conditions requires some skill, and that a voluntary stepping out must take place in this case also against the force of a release spring.

Furthermore, it is already known from Austrian Pat. No. 327 759 (which corresponds to U.S. Pat. No. 3,954,277) to support the release spring in the release lever and to thus produce a spring-package unit which is pivotal about a common swivel axis. It is disadvantageous that a voluntary stepping out must also occur in this construction against the force of a release spring.

German OS No. 28 38 904 describes a solution which was created substantially from combining features of the two last-mentioned Austrian patents and also contains their disadvantages.

The purpose of the invention is to bring help here and to design a safety ski binding of the above mentioned type in which the carrier is returned automatically to the initial position after a release operation or after a voluntary stepping out and is held in this position during a stepping in, even when the direction of stepping in differs from the vertical plane.

SUMMARY OF THE INVENTION

The set goal is achieved inventively by providing the locking elements for the two locking devices separated from one another on the carrier, the carrier being constructed as a swingable lever which has on its side which does not face the locking elements a control surface on which is supported a slide member biased by a release spring. The release spring is supported in a release lever which facilitates a voluntary stepping out and is unified with same to form a spring assembly. The spring assembly is pivotal against the force of a centering spring having one end supported on a ski-fixed structural part, on a structural part which is secured on the ski against a lifting off, or on the lever, and having the other end supported on the outer wall of the cylinder of the spring package with the interpositioning a spring abutment, the spring abutment having an extension at each of its end areas which is guided in a respective one of four recesses in the two sidewalls of the support member.

The inventively designed ski binding thus has the advantages of the known binding type according to Austrian Pat. No. 305 843, but without its disadvantages. Additional measures can be taken which permit further advantageous developments. Furthermore, the invention makes possible a selective operation of the binding through pull or through pressure.

A particularly advantageous embodiment of the invention lies in the lever, as is actually known, being supported on a holding axis which extends parallel to the horizontal swivel axis of the sole holder, which holding axis in turn is supported in a support member which can be pivoted about a swivel pin which forms a vertical axis and is anchored in a base plate, possibly against the force of a return spring. Through this measure a particularly compact design of the inventive ski binding is assured.

One inventive thought consists in one locking part, as known by itself, being provided on the rear area of the sole holder and another locking part of the other locking device of the lever or the sole holder, as also known by itself, being provided on a structural part which is fixable with respect to the ski. This assures that, after a release operation, the lever which is swung back into the initial position by the centering spring, additionally biased by the release spring, can be held for stepping in in the initial position.

In a further development of the thought of the invention, it is provided that the control surface of the lever, viewed in the drawing plane, has an S-shaped curvature with an inflection point, the inflection point being the contact point of the slide member on the control surface in the totally forwardly swung position of the lever corresponding to the case of a ski shoe with a low heel being clamped in. The centerpoint of the radius $R_1$ which determines the lower area of the S-curve lies either in the point of intersection of the centerline of the release spring and the swivel axis or offset with an eccentricity below said point of intersection, and the centerpoint of the radius $R_2$ which envelopes the upper area of the S-curve lies either on the active line of spring force of the release spring or offset with an eccentricity below such line, wherein $R_2$ is approximately twice as long as $R_1$. Through this measure, the designer is offered a way to design the binding for individual cases corresponding to respective conditions.

Inventively, it has proven to be advantageous when the offset of the first radius centerpoint $0_1$ is not greater than 4 mm. and is preferably 2 mm., and the offset of the second radius centerpoint $0_2$ is not greater than 8 mm. and is preferably 5 mm.

A still further thought of the invention lies in the slide member being substantially normal to the control surface in every position. Through this development, it is assured that swinging of the spring assembly can occur without a significant change in the preadjusted initial tension of the release spring. The term "significant change" is to be understood in such a manner that, due to the construction and due to manufacturing tolerances, a certain range of change of the initial tension of the spring is permitted, but having an order of magnitude which lies in the range of the frictional forces which are caused by the swinging.

In a further development of this inventive thought, it is provided that the structural part which is guided on the ski and supports one end of the centering spring is a cover which is clamped between two sidewalls of the support member and has a pocket to receive the end area of the centering spring. Through this, a particularly simple support for the centering spring is created.

In a modification of this inventive thought, the pocket in which the end of the centering spring is supported is constructed in a rearwardly shifted section of the lever. Thus, it is possible to shift the swivel axis of the lever rearwardly without influencing the centering spring. Furthermore, a separate support for the centering spring is not needed, because the lever itself serves as a support element.

A still different inventive thought consists in the swivel axis of the sole holder being formed by two kingpins which are supported on opposite sides of the support member in alignment with one another and support the release lever of the spring assembly, wherein between support member and release lever on at least one kingpin, preferably on both kingpins, there is arranged an opening spring for the sole holder. Thus, it is possible to mount the opening spring or springs on existing structural parts.

A still different inventive thought lies in the release spring in the spring assembly being supported on a flangelike part of the slide member. In this manner, it is not necessary to use a separate carrier member, for example, a spring plate, between the slide member and release spring.

A still different inventive thought lies in the rearwardly extended section of the lever having a support for one end of an opening spring for the sole holder, which spring is constructed as a torsion spring, the bent end area of the opening spring being guided in a preferably arcuately shaped slotted hole of the support member. Through this measure, the lever serves simultaneously and in a simple manner for the support of the one end of the opening spring of the sole holder.

A still further inventive thought lies in the lever having in its area which faces the base plate a recess in which is supported by means of an axle a roller which forms the projection, the cooperating locking part being constructed as a control cam on a rearwardly bent part of the base plate, which control cam, as actually known, has a blocking zone which acts against purely horizontal forces. Through this inventive development, the base plate fulfills simultaneously the task of the cooperating locking part, and the projection which is constructed as a roller creates smaller frictional forces than a sliding projection.

A different inventive development lies in the spring assembly being swingable against the force of a centering spring having one end supported on the support member and the other end supported on the cylinder of the spring assembly and guided in respective slots in the support member or the cylinder. The lifting off of the individual ends of the centering spring during opening of the binding occurs selectively depending on the pull and pressure, whereby existing structural parts serve here to support the free ends of the centering spring.

A still different inventive thought is characterized by the holding axis of the lever being shifted upwardly in the rear area of the support member and by the locking element which is effective for the horizontal release being provided on a rearwardly pointing additional spur of the sole holder. Thus, the designer has available for the swinging capability of the lever and for determining the control surface on the lever a modified lever relationship. Furthermore, the arrangement of a locking element pair between the sole holder and the ski-fixed structural part permits a control of the sole holder which is independent from the elevational swinging movement of the lever.

In a further development of the inventive thought, it is provided that the additional spur of the sole holder has a surface area which engages a control cam formed by an upwardly inclined bent part of the base plate, wherein said area of the spur is rounded by means of two radii for the purpose of a free up or down swinging of the sole holder.

BRIEF DESCRIPTION OF THE DRAWINGS

Further characteristics, advantages and details of the invention will now be described in greater detail in connection with the drawings, which illustrate several exemplary embodiments.

In the drawings

Figure 2:
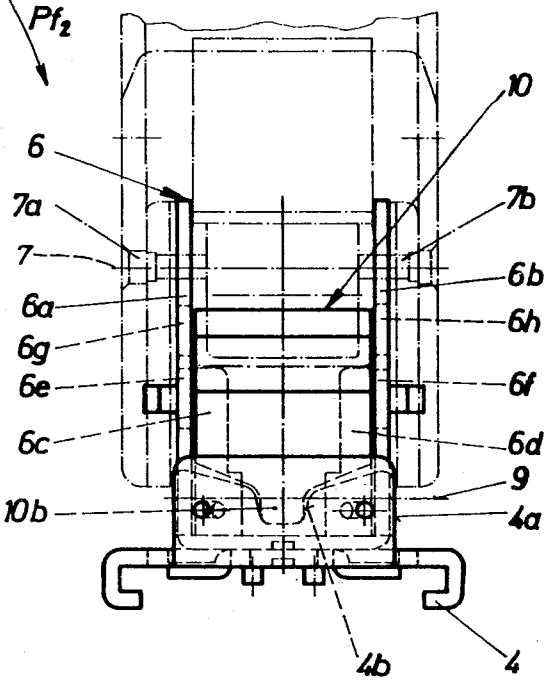
FIG. 2 is a front view of part of the heel holder of FIG. 1.

Identical structural parts are identified throughout the exemplary embodiments with the same reference numerals and, in the case of modifications which fulfill corresponding tasks, the related structural parts are identified with the same reference numeral and are differentiated with one or several primes (',",''').

DETAILED DESCRIPTION

In the first exemplary embodiment according to FIGS. 1 to 6, a safety ski binding which as a whole is identified as a heel holder 1 can be recognized. The heel holder 1 is held in a conventional manner against lifting off from the upper side of the ski 2 by means of a base plate 4 (FIG. 4) which engages a guide rail 3 secured on the upper side of a ski 2 in a conventional manner by not-illustrated screws. To adjust the heel holder 1 for different length ski shoes, the base plate 4 is moved relative to the guide rail 3 in the direction of the longitudinal axis of the ski and is secured in a conventional manner in any desired position. The type and manner of the longitudinal adjustment is not the subject matter of the present invention and is not discussed in detail.

A vertical axis is constructed as a swivel pin 5 (FIG. 1) which is rivieted in the base plate 4, about which vertical axis a support member 6 of the heel holder 1 is supported for pivotal movement, preferably against the force of a return spring 5*a*. The return spring 5*a* is a torsion spring which is arranged around the swivel pin 5. The end portions of the torsion spring 5*a* are anchored in the base plate 4. The support member 6 has at its upper area a swivel axis 7 (FIG. 2) formed by two kingpins 7*a* and 7*b* which are mounted in the support member and extend transversely to the longitudinal axis of the ski and parallel to the upper side of the ski 2, about which swivel axis 7 a sole holder 8 supported on the kingpins 7*a* and 7*b* can be pivoted upwardly. A holding axle 9 which extends parallel to the swivel axis 7 is supported in the lower area of the support member 6, on which holding axle 9 a lever 10 is pivotally supported. Furthermore, a spring assembly which is identified in its entirety with reference numeral 11 is pivotally supported on the kingpins 7*a* and 7*b*, the details of which spring assembly 11 will be discussed below.

Figure 4:
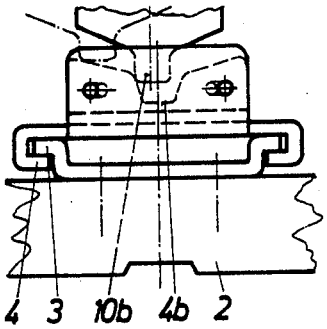
FIG. 4 is a front view of part of the heel holder of FIG. 3.

The lever 10 is, as is actually known, constructed as a carrier both for a locking element which yieldably resists elevational release forces and for a locking element which yieldably resists lateral release forces. For the locking against an upward swinging, a nose 10*a* is provided on the lever 10 which engages a notch of the sole holder 8, which notch is constructed as a locking cup 8*a*. For the locking effective against swinging in the horizontal plane, a projection 10*b* on the lever 10 engages a locking element which is constructed as a control cam 4*b* (FIG. 4). The control cam 4*b* is constructed in or on a holding plate 4*a* which is secured, in the present case riveted, to an upwardly bent part of the base plate 4. As shown in FIG. 2, the control cam includes a centrally located, upwardly open recess having spaced, substantially vertical side edges. Due to this design, the two locking elements 10*a* and 10*b* are locally separated on the lever 10 constructed as the carrier but, with respect to the holding axle 9 of the lever 10, are arranged on the same side of the lever 10.

The spring assembly 11 is supported on a control surface 10*c* of the lever 10 by means of a platelike slide member 12. The control surface 10*c* is, as can best be seen from FIG. 1*d*, constructed so that when a ski shoe is inserted and also in the case of a voluntary stepping out of the binding, in every position of the lever 10 the slide member 12 lies substantially normal to the control surface 10*c*. This means that the initial tension of the release spring 13 during the voluntary stepping out remains either unchanged or is reduced. Through this design of the control surface 10*c*, a stepping out is assured which requires only frictional forces be overcome.

Figure 1:
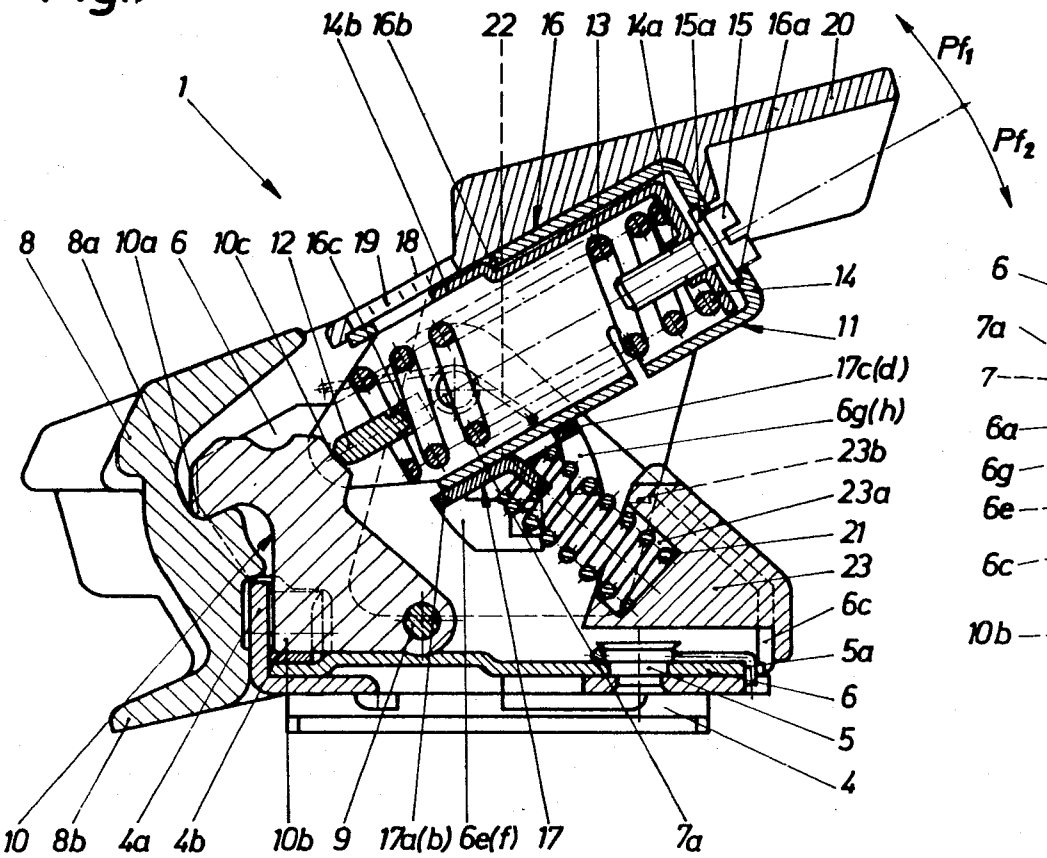
FIG. 1 is a longitudinal cross-sectional view of a first exemplary embodiment of the heel holder embodying the present invention in the downhill skiing position.
Figure 1A:
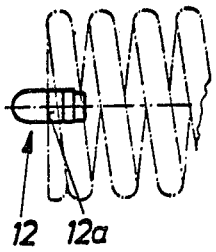
FIGS. 1*a*–1*d* illustrate details of components of the embodiment of FIG. 1.
Figure 1B:
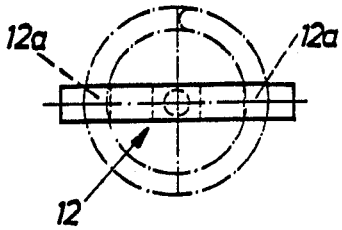
Figure 1C:
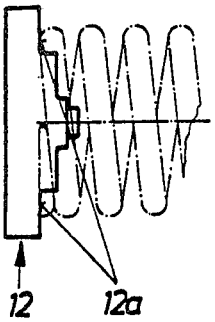
Figure 1D:
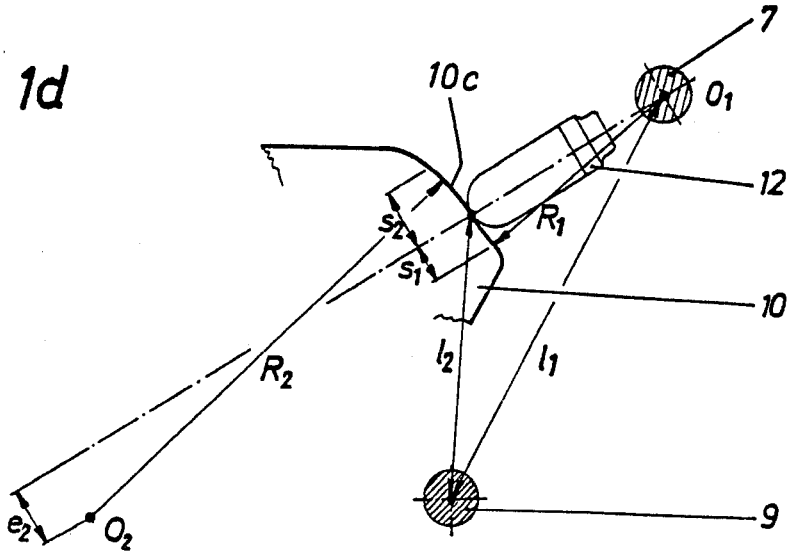

To achieve the above goal, the control surface 10*c*, with reference to FIG. 1*d*, is designed as follows. The swivel axis 7 which is formed by the two kingpins 7*a*,7*b* intersects the centerlines of the here not shown spring 13 and the illustrated slide member 12. Either at the point of intersection of the centerline of the spring 13 and the swivel axis 7 or eccentrically displaced downwardly therefrom, there is a centerpoint $0_1$ for a radius $R_1$ which determines the curvature of the lower half of the control surface 10*c*. It can easily be understood that, as viewed in the plane of the drawing, reference is made above to one point and to one curve, but that these correspond in three-dimensional space to a line and a surface, respectively. The lower end area of the control surface 10*c* passes over by means of a rounded portion into the further extend of the lever 10. The upper part of the support surface 10*c* is defined in a simplified manner by means of a radius $R_2$ which has a centerpoint $0_2$ located below the centerline of the spring 13 in FIG. 1*d*. Thus, control surface paths $S_1$ and $S_2$ are obtained, as shown in FIG. 1*d*. Further determining the structural relationships are the distance $l_1$ of the swivel axis 7 from the holding axis 9 and the distance $l_2$ of the contact point of the slide member 12 on the control surface 10*c* of the lever 10 from the holding axis 9. Attention must thereby be paid that the contact point of the slide member 12 on the control surface 10*c* of the lever 10 is known when the lever 10 lies in its totally forwardly swung position with a low heel ski shoe clamped in. In the case of a ski shoe with a normal heel or a higher heel, the position of the lever 10 is swung more rearwardly and the slide member 12 in this case also rests on the control surface 10*c* substantially normal thereto. Thus, for all conceivable sole heights, the condition is met that the stepping out occurs without an increase in the initial tension of the release spring 13. In a preferred embodiment, the individual dimensional values are as follows:

$R_1=18.5$, $R_2=40$, $l_1=37$ and $l_2=23$, all values being expressed in mm.

It can now easily be understood that, in the case of a change of the arrangement, the dimensions of the radii $R_1$ and $R_2$ must also be changed. Attention must thereby be paid to the fact that, as already mentioned, the radius $R_2$ is an approximate value, the corresponding support point (or rather the corresponding support line) of the slide member 12 on the control surface 10*c* of the lever 10 being determined for each lever position and being manufactured as a corresponding surface formed by a number of lines of intersection. Furthermore, it is understandable that the lower and the upper control surfaces are separated by an inflection line or turning line which contains the point in the drawing plane at which the slide member 12 rests, in the forwardly swung position of the lever 10 corresponding to the case of a clamped-in ski shoe with a low heel, on the control surface 10*c* of the lever 10.

The structure of the spring assembly 11 is as follows. The slide member 12 is biased by one end of a release spring 13, the other end of which is supported on a spring support 14. The spring support 14 has extending through it an adjusting screw 15 which in turn is rotatably supported in a cylindrical housing 16, but is supported nonmovably in the axial direction of the cylinder 16. The cylinder 16 has for this purpose a recess 16*a* in which the adjusting screw 15 is rotatably but axially nonmovably supported by means of a collar 15*a*. The area of the spring support 14 which the adjusting screw 15 threadedly engages is constructed as a threaded sleeve 14*a*, whereby operating the adjusting screw 15 adjusts the initial tension of the release spring 13 in a conventional manner. The cylinder 16 has a further recess 16*b* which extends parallel to the longitudinal axis of the release spring 13, in which recess 16*b* a free end 14*b* of a leg on the spring support 14 moves along markings 19 provided in a window 18 in a release lever 20, thereby visibly indicating the tension of the spring 13. The entire spring assembly 11 can be pivoted with and by means of the release lever 20 about the swivel axis 7 in the direction of either one of the arrows $Pf_1$ or $Pf_2$ (FIG. 1). To guide the slide member 12, elongated recesses 16*c* are provided in opposite sides of the cylinder 16 and receive the ends of the slide member 12. The slide member 12 and cylinder 16 are pivotally held in position on the control surface 10*c* of the lever 10 only through the force of a relatively weak centering spring 21, so that during a voluntary release effected by swinging the release lever 20 in the direction of one of the arrows $Pf_1$ or $Pf_2$, only the force of this weak centering spring 21 must be overcome. The release spring 13, however, is effective through its respectively adjusted force to yieldably resist a swinging up and/or a lateral release. The arrangement is such that a purely lateral release of the heel holder 1 is blocked in a conventional manner by the control cam 4*b* of the holding plate 4*a*, because the projection 10*b* on the lever 10 is held in a so-called blocking zone between the substantially vertical portions of the cam 4*b*. Thus, a purely lateral release operation, as is known, must be effected entirely by the not illustrated front jaw of the ski binding. In the case of diagonal forces, the control cam 4*b* comes into play. This method of operation will now be described in greater detail in connection with FIGS. 3 to 6.

Figure 3:
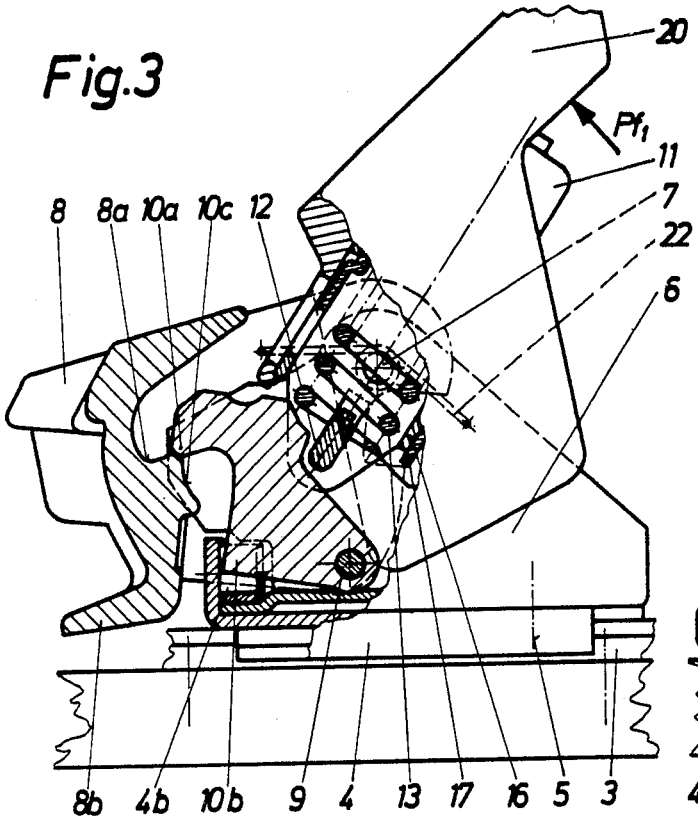
FIG. 3 is a view similar to FIG. 1 illustrating a position of the heel holder during a release operation.

FIGS. 3 and 4 illustrate a position during a release operation, it being of no importance whether we deal with a voluntary or an automatic release. The sole holder 8 is in a position in which the nose 10*a* of the lever 10 has just passed the limit of the range in which it can move without a release occurring, so that the locking nose 10*a* is totally disengaged from the locking cup 8*a*. Thus, in the phase of movement which follows, the sole holder 8 leaves the lever 10, even if no further forces act on it. It can be recognized from FIG. 4 that we deal there with a so-called diagonal release. The same result occurs when the release lever 20 is manually swung in the direction of the arrow $Pf_1$, except that the swinging up of the sole holder 8 against the lever 10 can now occur merely by overcoming frictional forces and possibly the urging of a relatively weak opening spring 22. The pivotal movement of the support member 6 about the swivel pin 5 is limited by a projection (not shown) which reaches into a recess in the base plate 4. Such structure is known per se.

Figure 5:
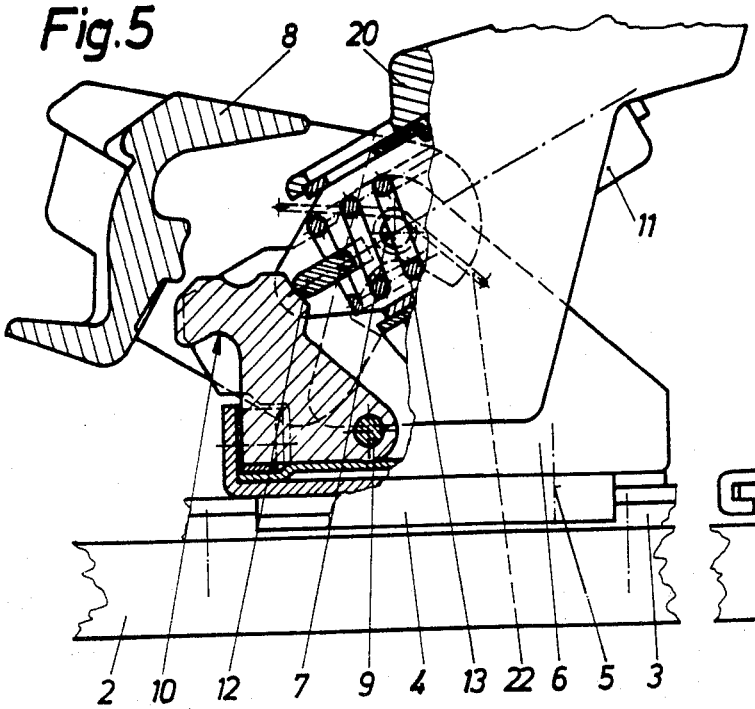
FIG. 5 is a view similar to FIG. 1 illustrating the position of the heel holder after a release operation.
Figure 6:
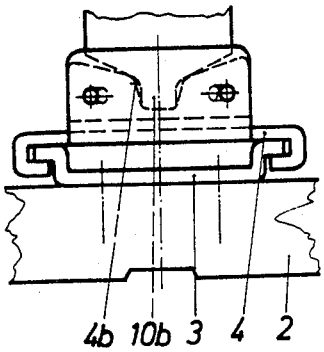
FIG. 6 is a front view of part of the heel holder of FIG. 5.

FIGS. 5 and 6 illustrate the sole holder 8 in the swung-out position which is also the position prior to a stepping in. The spring assembly 11 has been swung back into the initial position and the lever 10 is also in the initial position. A comparison of FIGS. 3 and 4 on the one hand and FIGS. 5 and 6 on the other hand shows that, by swinging the spring assembly 11 back into the initial position, the lver 10 is urged into its initial position by spring 13 and sliding member 12, thereby assuring that the lever 10 and sole holder 8 are in a position so that, even if the shoe of the skier is not placed exactly vertically on the spur 8*b* of the sole holder 8, the stepping in and closing of the heel holder 1 occurs in a centered position.

As best shown in FIG. 2, the swivel axis 7 is formed by two kingpins 7*a* and 7*b* which are supported on opposite sides of the support member 6 in alignment with one another and pivotally support the release lever 20 which partially envelopes the support member 6. The support member 6 and the release lever 20 are designed so that sufficient space remains between them on both sides for opening springs 22 which urge the sole holder 8 upwardly. The centering spring 21 is positioned with one end in a pocket 23*a* of a cover 23 which in turn is clamped between two sidewalls 6*a* and 6*b* of the support member 6. For this purpose, the sidewalls 6*a* and 6*b* of the support member 6 each have an inwardly projecting shoulder 6*c* and 6*d* which engages an extension 23*b* of the cover 23. The other end of the spring 21, with the interpositioning of a spring abutment 17, is supported on the outer wall of the cylinder 16 of the spring package 11. The spring abutment 17 has at its lateral end areas respective extensions 17*a,b* and 17*c,d* which are each received in a respective one of four guide recesses 6*e–h* provided in the sidewalls 6*a* and 6*b*. The centering spring 21 ensures that the spring assembly 11 is returned to its initial position after each release operation has been carried out, as is shown by a comparison of FIG. 1 (the downhill skiing position), FIG. 3 (the release operation) and FIG. 5 (the released position). This comparison will also show that the opening spring 22 urges the sole holder 8 toward a position for stepping in and holds it in such position when it is not locked in the downhill skiing position.

The operation of the heel holder 1 is as follows. In the case of a voluntary release operation, the release lever 20 together with the spring assembly 11 is manually pulled either in the direction of the arrow $Pf_1$ or is pressed in the direction of the arrow $Pf_2$ so that the spring assembly 11 pivots about the swivel axis 7 until slide member 12 is no longer engaging surface 10*c*, thereby permitting the sole holder 8 and lever 10 to be swung upwardly by the ski shoe heel practically without any resistance, which movement is further assisted by the urging of the opening spring 22. This method of operation is illustrated in FIGS. 3 to 6, whereby, as one can take from FIG. 3, the release occurred through movement of the spring assembly 11 in the direction of the arrow $Pf_1$. Furthermore, FIG. 4 shows that the sole holder 8, in addition to having been swung upwardly, has been swung laterally in a direction which corresponds with a pressing out of the heel of the right foot away from the other ski. This lateral movement is possible only after the projection 10*b* has moved upwardly sufficiently far so that it no longer engages the substantially vertical portions of the control cam 4*b*. After the ski shoe has been freed, the centering spring 21 presses the spring assembly 11 back into its initial position, and the spring assembly 11 in turn presses the lever 10 into its initial position so that the projection 10*b* of the lever 10 again engages the control cam 4*b* of the holding plate 4*a*. Thus, the heel holder 1 is again in the step-in position according to FIG. 5. During the foregoing operation, the extensions on the spring abutment 17 move selectively in the recesses 6*e*,6*f*, 6*g* and 6*h* in the support member 6. The optional return spring 5*a* facilitates centering of the lever 10.

When an automatic release occurs, for example due to a fall of the skier, upward movement of the sole holder 8 due to the forces applied by the ski shoe heel causes the lever 10 to swing upwardly against the force of the release spring 13, moving the slide member 12 rearwardly in the guide recess 16*c* of the cylinder 16 in the direction of the longitudinal axis of the release spring 13. The construction of the slide member 12 and the arrangement of the release spring 13 can best be seen in FIGS. 1*a–c*. The release spring 13 is supported on surfaces on flangelike parts 12*a* of the slide member 12, so that no separate carrier member, for example, a spring plate, is needed between slide member 12 and the release spring 13.

If the upward force from the foot of the skier has a lateral component, then the projection 10*b* of the lever 10 is removed from the control cam 4*b* of the holding plate 4*a* upwardly and laterally, as is shown in, and as has already been described in connection with FIG. 4. Upon the occurrence of purely lateral forces, the heel holder 1 remains closed, due to engagement between the projection 10*b* and the blocking zone of the control cam 4*b*. The ski shoe is, in this case, released in a conventional manner by a not-illustrated front jaw.

Figure 8:
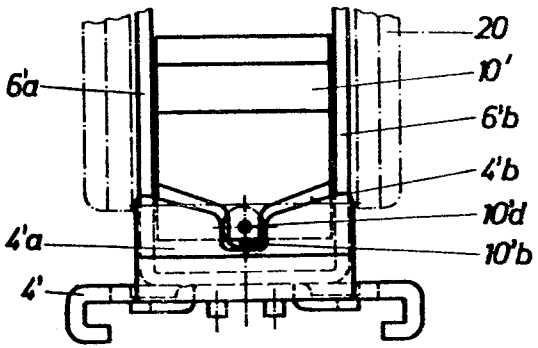
FIGS. 7 and 8 are views similar to FIGS. 1 and 2 which illustrate a second exemplary embodiment having a modified locking mechanism.
Figure 7:
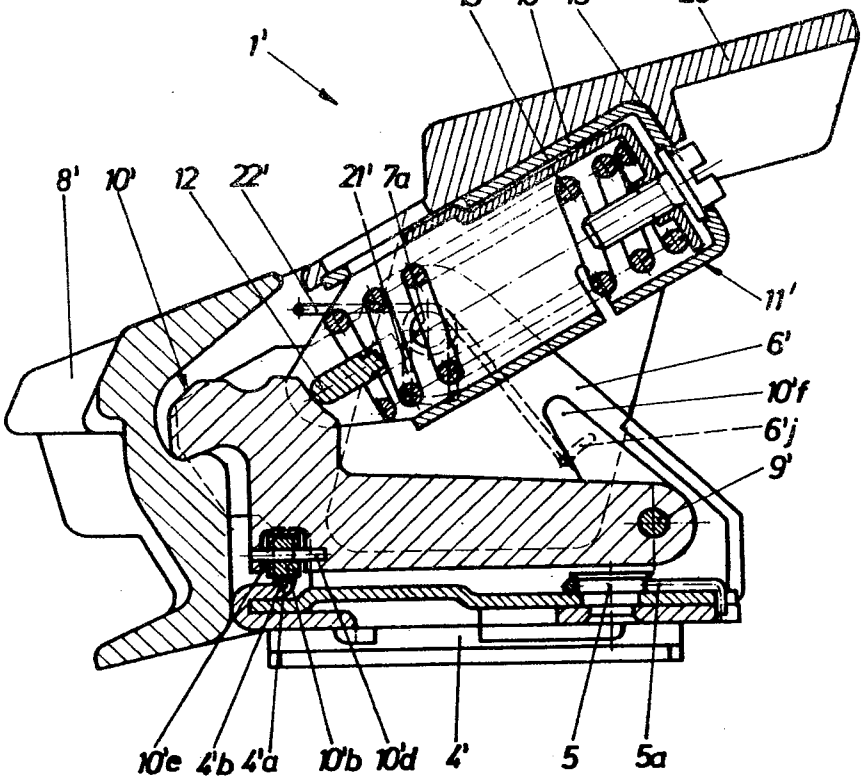

In the second exemplary embodiment according to FIGS. 7 and 8, the heel holder 1' has a lever 10', the holding axis 9' of which is located in the rear area of the support member 6'. The lever 10' has a second leg or support 10'*f* against which an end of an opening spring 22' which is a leg or torsion spring is supported. A bend end area of the leg of the opening spring 22' is guided in an arcuate slotted hole 6'*j* in the support member 6'. The other end is supported on the sole holder 8'.

A roller 10'*b* forms the projection in this exemplary embodiment and is supported in a recess 10'*e* in the lever 10' by means of an axle 10'*d*. The control cam 4'*b* is provided on a rearwardly bent part 4'*a* of the base plate 4'. In this manner, the frictional forces which occur between the two locking parts (the roller 10'*b* and the control cam 4'*b*) are reduced. By moving the holding axis 9' to the rear area of the support member 6', the capability of swinging of the lever 10' can be adjusted to respective requirements to an increased degree. Due to this arrangement, a change in the support area for the centering spring 21' becomes necessary, as a result of which a different arrangement was chosen in which the centering spring 21' is a torsion spring encircling a kingpin 7*a* or 7*b* and having one end supported on the support member 6' and the other end on the cylinder 16', each end being guided in a slot in the support member 6' or the cylinder 16'. The lifting off of the ends of the centering spring 21' during opening occurs selectively, depending on the pull and pressure. (See the arrows $Pf_1$ and $Pf_2$ respectively in FIG. 1). Pulling the release lever 20, the cylinder 16' swings in the direction of the arrow $Pf_1$ and one end of the centering spring 21' moves e.g. in the slot of the support member 6'. By exerting pressure on the release lever 20, the cylinder 16' swings in the direction of the arrow $Pf_2$ and the other end of the centering spring 21' moves in the slot of the cylinder 16'. If the release lever 20 becomes free of the hand of the skier the centering spring 21' effects in each case a recentering of the cylinder 16'. It is thereby advantageous if a return spring 5*a* as shown and described in FIG. 1 is used here too.

Figure 9:
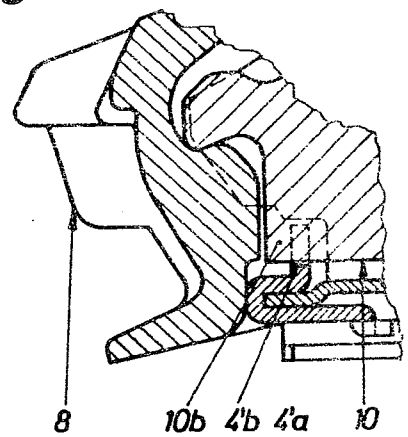
FIG. 9 is a view similar to part of FIG. 1 which illustrates a further modification of the locking mechanism.

The exemplary embodiment which is illustrated in FIG. 9 shows only a modification of the locking elements for the lateral release. It can there be recognized that the projection 10*b* of the lever 10 is constructed similar to that in the embodiment of FIG. 1, but the control cam 4'*b* is constructed from the base plate 4' in a manner similar to the embodiment according to FIGS. 7 and 8.

Figure 10:
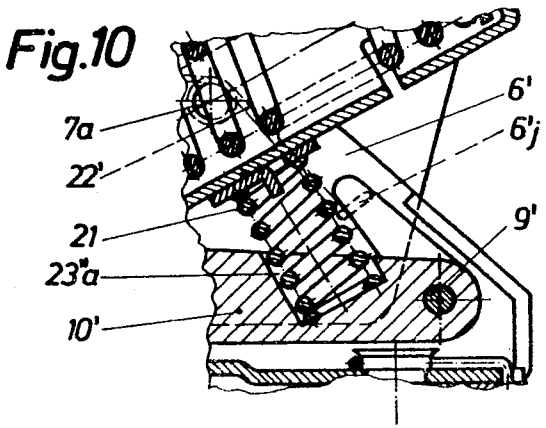
FIG. 10 illustrates a modification of the centering spring in the embodiment according to FIGS. 7 and 8 which is similar to the construction according to FIGS. 1 and 2.

The embodiment according to FIG. 10 illustrates a combination of the centering spring 21 according to FIGS. 1 to 6 with an opening spring 22' according to FIGS. 7 and 8. However, the pocket 23''*a* in this case differs from the embodiment illustrated in FIGS. 1 to 6, in that it is provided in the lever 10'. This is necessary to permit the pivotal support of the lever 10' in the rear area of the support member 6'.

Figure 12:
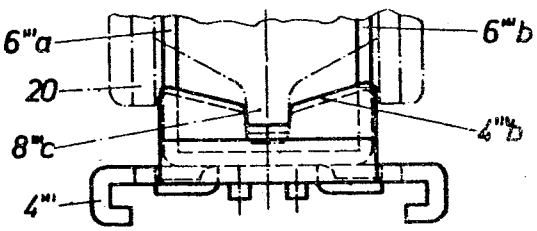
FIGS. 11 and 12 are views similar to FIGS. 1 and 2 which illustrate a further exemplary embodiment having a further modification of the control cam and one of the locking mechanisms.
Figure 11:
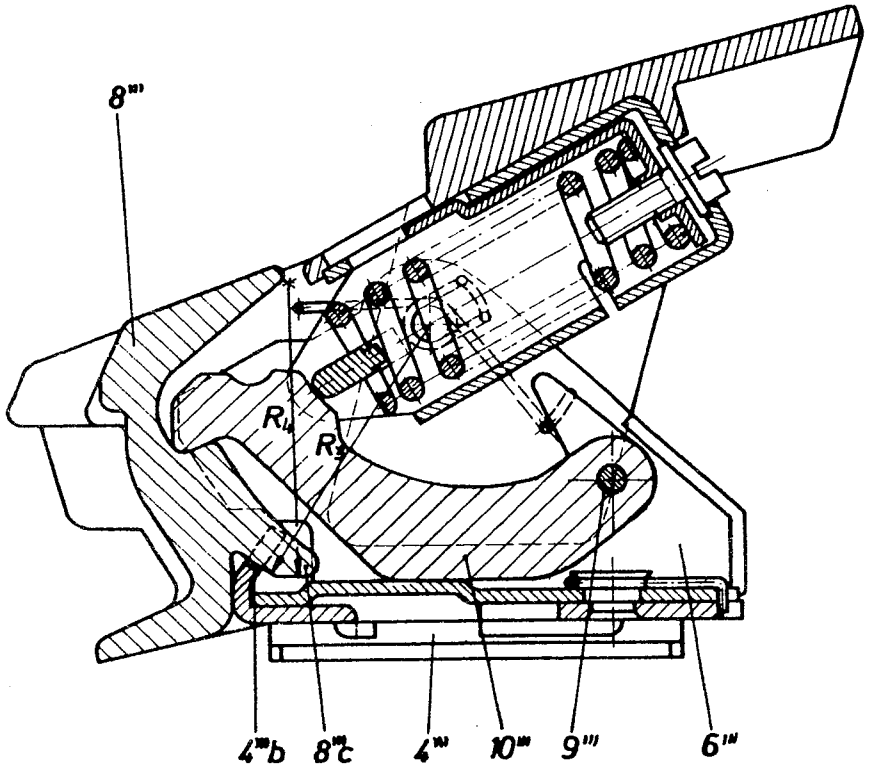

In the embodiment according to FIGS. 11 and 12, the lever 10''' has yet a further modification in that its holding axis 9''' is not only arranged in the rear area of the support member 6''', but is also shifted upwardly. Furthermore, the locking elements which are responsible for the horizontal release are formed between a rearwardly pointing spur 8'''*c* on the sole holder 8''' and a control cam 4'''*b* which is provided on a bent base plate 4'''. As one can see from FIG. 11, the surface area of the additional spur 8'''*c* (not identified separately) is rounded off by means of two radii $R_3$ and $R_4$ so that, in each position of the sole holder 8''' and the lever 10''', a free up or down swinging of the sole holder 8''' is assured.

The invention is not limited to the listed exemplary embodiments. Modifications are conceivable without leaving the scope of the invention. In particular, inventively important characteristics can be used in combination. It is also conceivable to use these characteristics in combination with other safety ski binding designs.

The embodiments of the invention in which an exclusive property or privilege is claimed are defined as follows:

1. In a safety ski binding having a sole holder supported on a support member for pivotal movement about a horizontal first axis, said support member being supported on a base for pivotal movement about a vertical second axis, locking means for yieldably maintaining said sole holder in a downhill skiing position holding a ski shoe, said locking means including cooperating locking elements and yielding only when release forces applied to said sole holder exceed predetermined limits, at least one said locking element being provided on a carrier, the improvement comprising wherein said carrier is a locking lever pivotally supported on said support member and having on a side thereof remote from said one locking element a control surface, including a release lever supported on said support member for pivotal movement about a third axis, a release spring supported on said release lever, a slide member movably supported on said release lever and biased toward said control surface by said release spring, and wherein said release lever is pivotal against the force of a centering spring having one end supported on one of said support member and said locking lever and the other end supported on said release lever.

2. The binding according to claim 1, wherein said locking lever is supported for pivotal movement about a fourth axis which extends generally parallel to said first axis, said support member being pivotal about a swivel pin which defines said vertical second axis and is anchored in said base.

3. The binding according to claim 1, wherein said locking means includes a second locking element which is cooperable with said one locking element on said locking lever and is provided on a rear side of said sole holder, and wherein said locking means includes third and fourth locking elements, said fourth locking element being provided on one of said lever and said sole holder and said third locking element being cooperable with said fourth locking element and being provided on said base.

4. The binding according to claim 1, wherein said release spring is helical and the centerline thereof intersects said third axis at a point, wherein said control surface of said locking lever, viewed in a side view, has an S-shaped curvature with an inflection point, said inflection point being engaged by said slide member in a position of said locking lever which occurs when a ski shoe with a low heel is clamped in said binding, and wherein the centerpoint of a first radius which determines a first part of said S-shaped control surface lies at one of said point of intersection of the centerline of said release spring and said third axis and a point offset below said point of intersection, and wherein the centerpoint of a second radius which determines a second part of said S-shaped control surface lies at one of a point on the centerline of said release spring and a point offset below such centerline, said second radius having a length approximately twice that of said first radius.

5. The binding according to claim 4, wherein said offset of said first radius centerpoint is not greater than 4 mm and said offset of said second radius centerpoint is not greater than 8 mm.

6. The binding according to claim 1, wherein said slide member is elongate in the direction of movement thereof, and wherein said slide member is substantially normal to said control surface in every position of said locking lever.

7. The binding according to claim 1, wherein said support member includes two laterally spaced sidewalls and a cover which is clamped between said sidewalls, said cover having a pocket therein which receives said one end of said centering spring.

8. The binding according to claim 1, including a pocket in said locking lever in which said one end of said centering spring is supported.

9. The binding according to claim 1, wherein said first and third axes are coincident and defined by two spaced kingpins which are supported on said support member in coaxial alignment with one another and pivotally support said release lever and said sole holder, and wherein between said support member and said release lever, on at least one said kingpin, there is arranged an opening spring which cooperates with said sole holder and urges it toward an open position.

10. The binding according to claim 1, wherein said slide member has a flangelike part, wherein said release spring is helical, and wherein an end of said release spring is supported on said flangelike part of said slide member.

11. The binding according to claim 8, including an opening spring which is a torsion spring having two legs, one said leg of said torsion spring cooperating with said sole holder and urging it toward an open position, wherein said locking lever has a support on which the other said leg of said opening spring is supported, and wherein a bent region at the end of said other leg of said opening spring is guided in a slot provided in said support member.

12. The binding according to claim 1, wherein said locking lever has in a surface which faces said base a recess in which a roller is rotatably supported, said roller being a second said locking element, and wherein a third said locking element cooperable with said second locking element is a control cam provided on a backwardly bent part of said base, said control cam including an upwardly open further recess having spaced, generally vertical sides, said second locking element being received in said further recess when said sole holder is in said downhill skiing position.

13. The binding according to claim 3, wherein said centering spring is a torsion spring having two legs, one said leg being supported on said support member and the other said leg being supported on said release lever, the end of each said leg being guided in a respective slot provided in said support member and said release lever.

14. The binding according to claim 1, wherein the pivot axis of said locking lever is located in an upper rear region of said support member, and wherein one of said locking elements is a rearwardly projecting spur provided on said sole holder.

15. The binding according to claim 14, wherein said spur of said sole holder has a surface which engages a control cam provided on said base, said surface of said spur being defined by two rounded curves having respective radii to facilitate pivotal movement of said sole holder.

16. The binding according to claim 1, wherein said support member includes two substantially upright, laterally spaced sidewalls, at least one said sidewall having a guide recess therein in the region of said third axis, said release lever being pivotally supported on and between said sidewalls and having thereon a spring abutment on which said other end of said centering spring is supported, said spring abutment having a laterally projecting extension thereon which is received in said guide recess and moves within said guide recess in response to pivotal movement of said release lever.

17. In a safety ski binding having a sole holder supported on a support member for pivotal movement about a horizontal first axis, said support member being supported on a base for pivotal movement about a vertical second axis, locking means for yieldably maintaining said sole holder in a downhill skiing position holding a ski shoe, said locking means including cooperating locking elements and yielding only when release forces applied to said sole holder exceed predetermined limits, at least one said locking element being provided on a locking lever which is pivotally supported on said support member and has a control surface on a side thereof remote from said one locking element, including a release lever supported on said support member for pivotal movement about a third axis, a release spring supported on said release lever, a slide member movably supported on said release lever and biased toward said control surface by said release spring, the improvement comprising wherein said release spring is pivotal together with said release lever about said third axis, said third axis extending substantially parallel to said first axis, wherein said release lever is pivotal against the force of a centering spring having one end supported on one of said support member and said locking lever and having the other end supported on said release lever, and wherein said slide member is elongate and in each position of said locking lever is substantially normal to said control surface.

18. The binding according to claim 16, wherein said release spring is helical and the centerline thereof intersects said third axis at a point, wherein said control surface on said locking lever, viewed in a side view, has a reverse curvature with a turning point, said turning point being engaged by said slide member in a position of said locking lever which occurs when a ski shoe with a low heel is clamped in, and wherein the centerpoint of a first radius which determines a first part of said control surface lies at one of said point of intersection of the centerline of said release spring and said third axis and a point offset below said point of intersection, and wherein the centerpoint of a second radius which determines a second part of said control surface lies at one of a point on the centerline of said release spring and a point offset below such centerline, said second radius having a length approximately twice that of said first radius.

19. The binding according to claim 17, wherein said offset of said first radius centerpoint is not greater than 4 mm and said offset of said second radius centerpoint is not greater than 8 mm.

20. A safety ski binding, comprising a base adapted to be mounted on a ski; a support member supported on said base for pivotal movement about a substantially vertical first axis; a sole holder supported on said support member for pivotal movement about a substantially horizontal, transverse second axis between a downhill skiing position adjacent said base and a released position spaced from said base, said sole holder having a first locking part thereon; a locking lever supported on said support member for pivotal movement about a third axis generally parallel to said second axis, having a second locking part thereon which is engageable with said first locking part on said sole holder when said sole holder is in said downhill skiing position, and having a control surface on a side thereof opposite from said second locking part; locking means for preventing pivotal movement of said support member about said first axis when said sole holder is in said downhill skiing position and until said sole holder has moved upwardly a predetermined distance away from said downhill skiing position toward said released position, said locking means including a third locking part on said base and a fourth locking part on one of said sole holder and said support member which is cooperable with said third locking part; a release lever supported on said support member for pivotal movement about a fourth axis generally parallel to said second axis; a slide member slidably supported on said release lever for movement toward and away from said control surface on said locking lever; first resilient means supported on said release lever and cooperable with said slide member for yieldably urging said slide member into engagement with said control surface on said locking lever and thus yieldably urging pivotal movement of said locking lever into a position in which said first and second locking elements cooperate and yieldably resist upward movement of said sole holder away from said downhill skiing position; and second resilient means cooperable with said release lever for yieldably urging said release lever toward a predetermined angular position.

21. The binding according to claim 20, wherein said support member includes two substantially upright, laterally spaced sidewalls, at least one said sidewall having a guide recess therein in the region of said fourth axis, said release lever being pivotally supported on and between said sidewalls and having thereon a spring abutment, said spring abutment having a laterally projecting extension thereon which is received in said guide recess, and wherein said second resilient means includes a helical compression spring having one end supported on said spring abutment and its other end supported in a pocket provided in one of said locking lever and said support member.

22. The binding according to claim 20, wherein said first resilient means includes a helical release spring extending generally parallel to the direction of movement of said slide member, having one end supported on said slide member, having the other end supported on said release lever, and having a centerline which intersects said fourth axis at a point, and wherein said control surface on said locking lever, viewed in a side view, has an S-shaped curvature with an inflection point, the centerpoint of a first radius which defines a first portion of said S-shaped control surface being located at one of said point of intersection of the centerline of said release spring and said fourth axis and a point below said point of intersection, and the centerpoint of a second radius which defines a second portion of the S-shaped control surface being located at one of a point on the centerline of said release spring and a point therebelow, the length of said second radius being approximately twice that of said first radius.

23. The binding according to claim 20, wherein said support member includes two laterally spaced sidewalls, wherein said first and second axes are coincident and are defined by two kingpins which are supported on respective said sidewalls of said support member in coaxial alignment with one another and pivotally support said sole holder and said release lever, and wherein between one said sidewall of said support member and said release lever on one said kingpin there is provided an opening spring which cooperates with said sole holder and said support member and yieldably urges said sole holder toward said released position.

24. The binding according to claim 20, wherein said locking lever has a support thereon, and including an opening spring which is a torsion spring having two legs and which urges said sole holder toward said released position, one said leg of said opening spring being supported on said sole holder and the other said leg of said opening spring being supported on said support of said locking lever and having a bent end which is slidably received in an arcuate slot provided in said support member.

25. The binding according to claim 20, wherein said fourth locking part is on said locking lever and includes a downwardly open recess in said locking lever and a roller rotatably supported in said recess, and wherein said third locking part is a control cam provided on said base, said control cam including an upwardly open recess having laterally spaced, substantially upright side surfaces.

26. The binding according to claim 20, wherein said second resilient means includes a centering spring which is a torsion spring having two legs, one said leg being supported on said support member and the other said leg being supported on said release lever, the ends of said legs being guided in slots respectively provided in said support member and said release member.

27. The binding according to claim 20, wherein said fourth locking part is provided on said sole holder and is a rearwardly pointing spur, and wherein said third locking part is a control cam on said base having an upwardly open recess which receives said spur when said sole holder is in said downhill skiing position.

* * * * *

UNITED STATES PATENT AND TRADEMARK OFFICE

CERTIFICATE OF CORRECTION

PATENT NO. : 4 421 341

DATED : December 20, 1983

INVENTOR(S) : Erwin Krob and Helmut Bauer

It is certified that error appears in the above-identified patent and that said Letters Patent is hereby corrected as shown below:

Col. 11, line 40; before "lever" insert ---locking---.

Col. 13, line 33; change "claim 16" to ---claim 17---.

Col. 13, line 51; change "claim 17" to ---claim 18---.

Col. 14, line 10; change "support member" to ---locking lever---.

Col. 14, line 61; change "first" to ---fourth---.

Col. 16, line 10; change "member" (second occurrence) to ---lever---.

Signed and Sealed this

*Twenty-second* Day of *May 1984*

[SEAL]

*Attest:*

GERALD J. MOSSINGHOFF

*Attesting Officer*

*Commissioner of Patents and Trademarks*